United States Patent [19]

Newell

[11] Patent Number: 4,568,296

[45] Date of Patent: Feb. 4, 1986

[54] SINGLE AND MULTIPLE PLANE CONTOURED WATER SKI CORRECTIVE WEDGES SECURED OR FORMED BETWEEN WATER SKI BINDINGS AND WATER SKIS

[76] Inventor: Stanley G. Newell, 3333 NE. 182nd., Seattle, Wash. 98155

[21] Appl. No.: 587,393

[22] Filed: Mar. 8, 1984

[51] Int. Cl.[4] ..... A63C 15/06

[52] U.S. Cl. ..... 441/70; 280/636

[58] Field of Search ..... 441/65, 67, 68, 70, 441/74, 75; 280/601-609, 636, 816, 11.14, 11.15, 633; D21/228-231

[56] References Cited

U.S. PATENT DOCUMENTS 3,917,298 11/1975 Haff ..... 280/607

FOREIGN PATENT DOCUMENTS 2723864 11/1978 Fed. Rep. of Germany ..... 280/607

64864 5/1942 Norway ..... 280/636

*Primary Examiner*—Trygve M. Blix

*Assistant Examiner*—Jesûs D. Sotelo

*Attorney, Agent, or Firm*—Roy E. Mattern, Jr.

[57] ABSTRACT

Single and multiple plane contoured water ski corrective wedges secured or formed between the water ski bindings and water skis are provided to position a water skier's feet on water skis in closer to normal positions relative to their legs, knees, and hips to provide better control of the water skis and to comfortably position the water skier's feet to avoid improper stressing of their feet, knees, legs and back. Better overall water ski performances are accomplished as the water skier uses his or her forefoot more extensively than previously, when most control was derived from the using of only the rearfoot. Depending on the selections made by water skiers, they use single and/or multiple plane contoured receiving corrective wedges, under either one or both of their feet. These water ski corrective wedges are used with a slalom water ski, and with water skis to be used at the same time on the respective right and left foot of a water skier. The water ski corrective wedges are made separately, and/or preformed with the bindings, and/or with the water skis.

18 Claims, 17 Drawing Figures

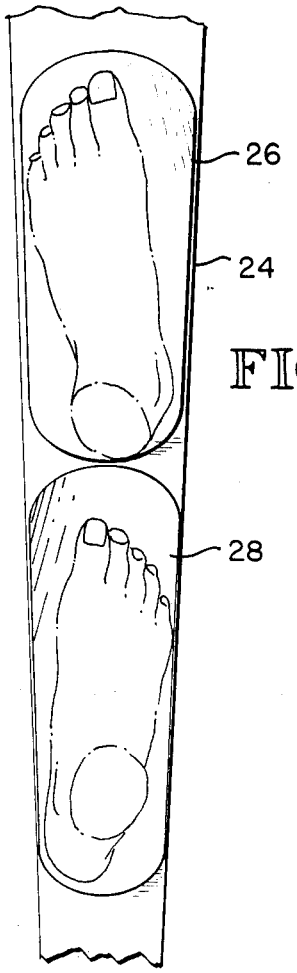
FIG. 4
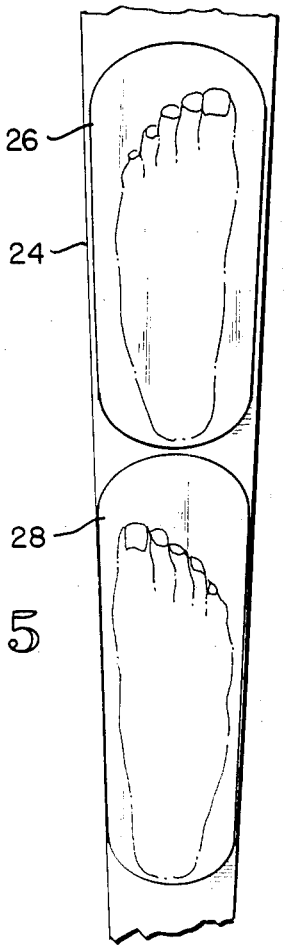
FIG. 5
FIG. 6
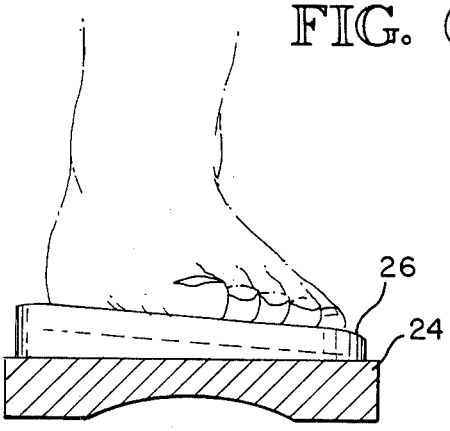
FIG. 7
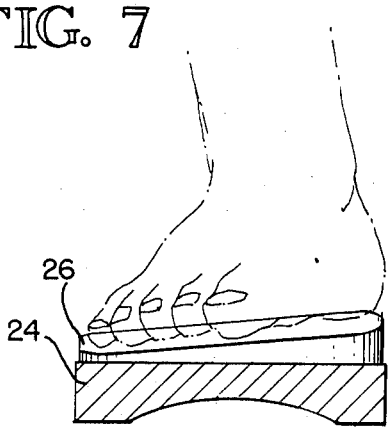

SINGLE AND MULTIPLE PLANE CONTOURED WATER SKI CORRECTIVE WEDGES SECURED OR FORMED BETWEEN WATER SKI BINDINGS AND WATER SKIS

BACKGROUND OF THE INVENTION

In a review of United States patents, none were observed which pertained to corrective wedges or other structures possibly usable or used to improve the positioning of the feet of water skiers on their water skis. Paul F. Curry in his U.S. Pat. No. 4,241,929 of 1980 illustrated and described his ski board with improved foot treads having respective upturned ends to prevent fore and aft slippage of the skier's feet.

In the marketplace, corrective wedges are available, tapered transversely in a single plane in two sizes, being either a $\frac{1}{8}''$ or $\frac{1}{4}''$ maximum thickness dimension wedge, and they are combinable for a $\frac{3}{8}''$ maximum dimension. These plastic plate corrective wedges fit under the water skier's forward foot between the water ski binding and the slalom water ski. Their use in effect builds up the binding under the instep side of the water skier's foot. As a consequence, a water skier skiing on a slalom water ski equipped with this corrective wedge under a forward foot makes his or her turns without having a noticeably weaker side turn. However, there remained a need for providing better control and comfort to a water skier.

SUMMARY OF THE INVENTION

Better control, comfort, and limited stressing is realized by a water skier who utilizes single and/or multiple plane contoured water ski corrective wedges secured between water ski bindings and water skis or preformed with the water ski bindings and/or water skis. By using multiple plane corrective wedges under both feet of a water skier, his or her feet are more comfortably positioned, being closer to normal degree positions in respect to the angle between their respective feet and legs, with the forefoot being used more in controlling the water ski. Essentially a seventy degree angle or higher degree angle is maintained, as viewed in a side view or in a sagital plane in reference to the angle between one's foot and leg during the near standing up phase of a water skiing cycle, during which a water skier moves from one side to the other of a boat's wake. Also there essentially is no further excessive or abnormal longitudinal or transverse angulation of a skier's foot. A skier's foot is not abnormally adducted or abducted, inverted or everted, or plantarflexed or dorsiflexed.

DESCRIPTIONS OF THE DRAWINGS

Preferred embodiments of the single and/or multiple plane contoured water ski corrective wedges secured between the bindings and water skis are illustrated in the drawings, wherein, primarily a slalom water ski is shown, and also a slalom water ski for a left leg forward water skier is shown:

FIG. 4 is a partial view with portions removed looking down on the preferred positioning of the feet of a water skier when multiple plane receiving corrective wedges are used on a slalom water ski, i.e. the feet are at an angle with the longitudinal axis of the slalom water ski, and the water ski bindings are not shown;

FIG. 5 is a partial view with portions removed looking down on the previously conventional positioning of the feet of a water skier, i.e. the feet are aligned with the longitudinal axis of the slalom water ski, and the water ski bindings are not shown;

FIG. 6 is a partial front view with portions removed illustrating the position of the left foot and leg, in respect to angular position of FIG. 4, which are placed nearer the bow or front of the slalom water ski and on a multiple plane receiving corrective wedge, and the water ski binding is not shown;

FIG. 7 is a partial front view with portions removed showing the position of the right foot and leg, in respect to the angular position of FIG. 4, which are placed nearer the stern or rear of the slalom water ski and on a multiple plane receiving corrective wedge, and the water ski binding is not shown;

Figure 11:
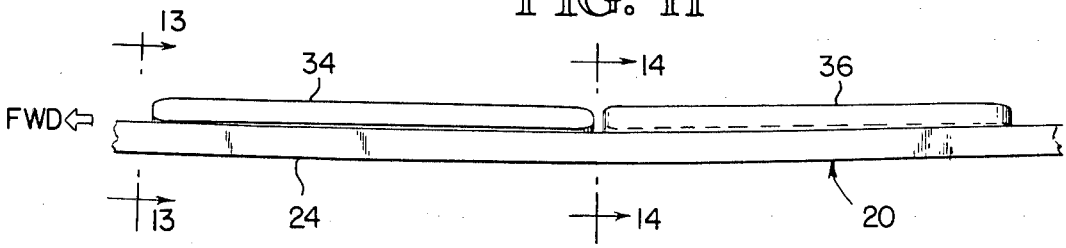
FIG. 11 is an enlarged partial left or port side view of the slalom water ski and the fore and aft single plane contoured water ski binding receiving corrective wedges, before installation of the water ski bindings, illustrating only contour changes, as considered in respect to a frontal plane reference of a water skier, in regard to avoiding inversion or eversion motions of a water skier's feet.
Figure 12:
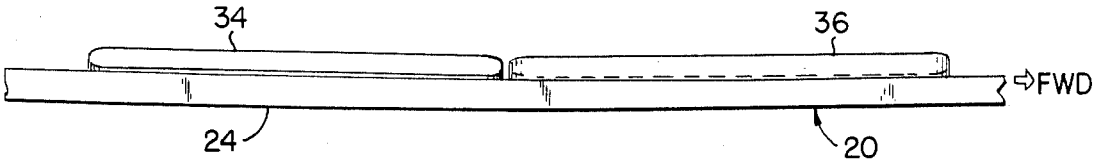
Figure 13:
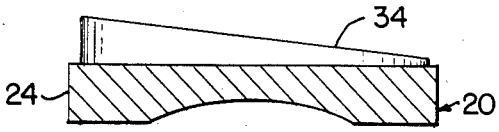
Figure 14:
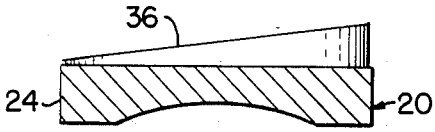
Figure 15:
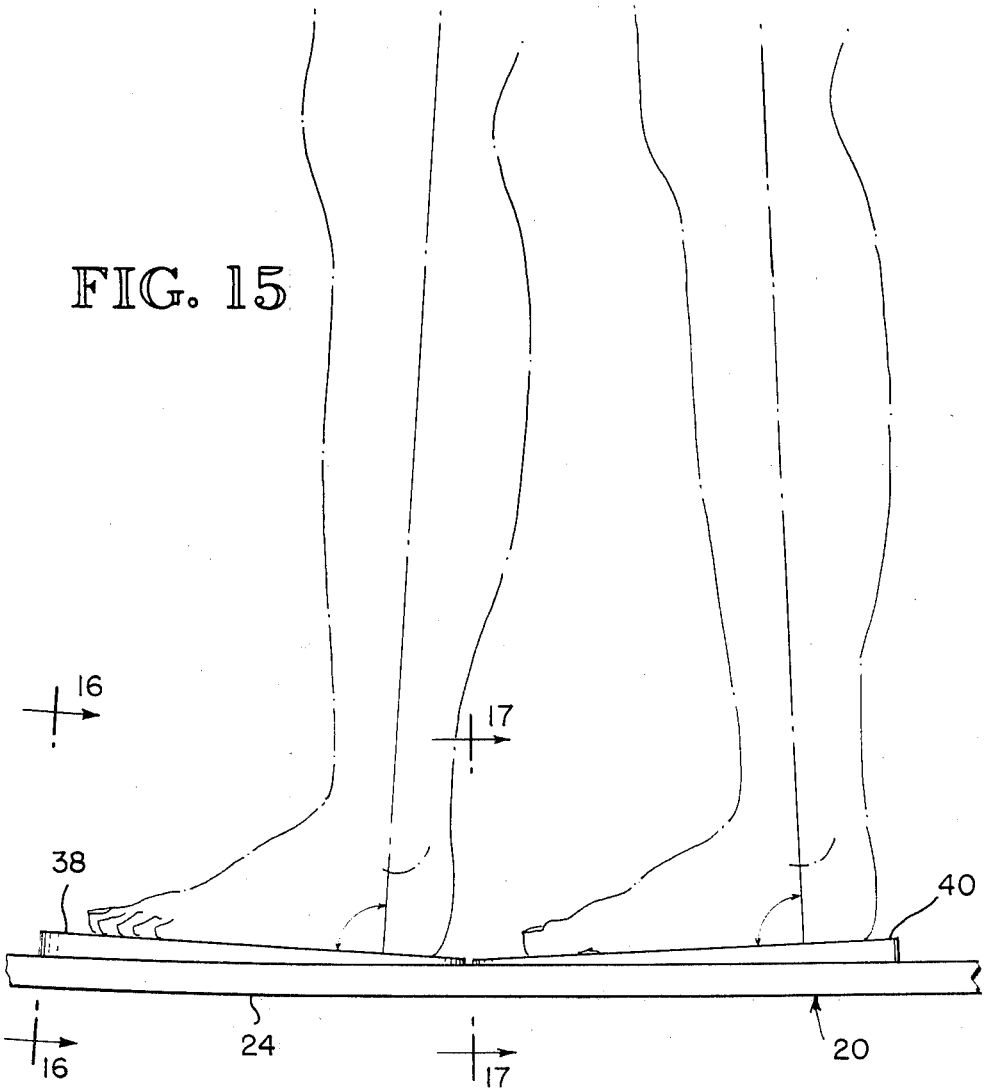
Figure 16:
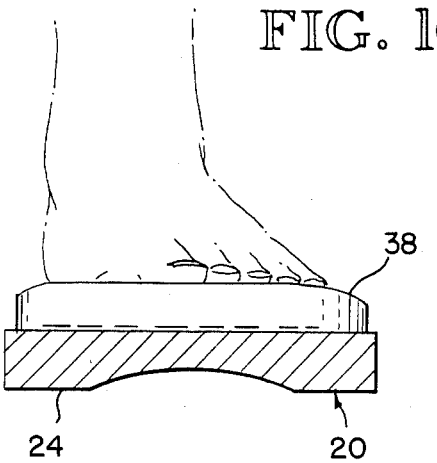
Figure 17:
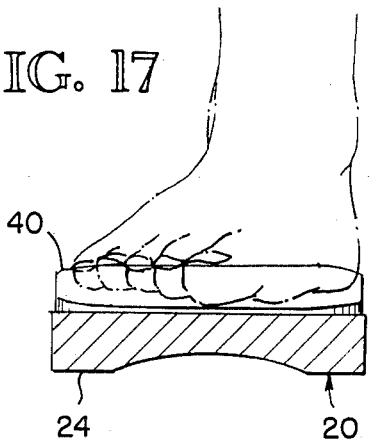

FIG. 12 is an enlarged partial right or starboard side view of the slalom water ski and the fore and aft single plane contoured water ski binding receiving corrective wedges, before installation of the water ski bindings, illustrating only contour changes, as considered in respect to a front plane reference of a water skier, in regard to avoiding inversion or eversion motions of a water skier's feet;

FIG. 13 is a cross sectional view of the slalom water ski and the forward single plane transversely contoured water ski binding receiving corrective wedge taken along section line 13—13 of FIG. 11, to indicate the single plane transverse contour of the forward receiving corrective wedge;

FIG. 14 is a cross sectional view of the slalom water ski and the aft single plane transversely contoured water ski binding receiving corrective wedge taken along section line 14—14 of FIG. 11, to indicate the single plane transverse contour of the aft receiving corrective wedge;

FIG. 15 is a partial left side view of the slalom water ski illustrating the positions of the feet and legs of a water skier in respect to his or her use of the single plane longitudinal contoured water ski binding receiving corrective wedges; for illustrative purposes the water ski binding is not shown;

FIG. 16 is a cross sectional view of the slalom water ski and the forward single plane longitudinal contoured water ski binding receiving corrective wedge taken along section line 16—16 of FIG. 15 to indicate the single plane longitudinal contour of the forward receiving corrective wedge; and FIG. 17 is a cross sectional view of the slalom water ski and the rear single plane longitudinal contoured water ski binding receiving corrective wedge taken along section line 17—17 of FIG. 15 to indicate the single plane longitudinal contour of the aft receiving corrective wedge.

DESCRIPTION OF THE PREFERRED EMBODIMENTS

To Better Understand why the Preferred Embodiments are Provided, References are Made to Sources of Medical Information and Terms Which Although Direct to Runners are Considered to be Pertinent to Water Skiers Doctors of D.P.M., Merton L. Root, William P. Orien, John H. Weed and Robert J. Hughes in Volume I of their book entitled *Biomechanical Examination of the Foot,* illustrate and describe the structures and motions of persons' feet in respect to designated axes of motion and designated geometric planes of observations. In respect to injuries sustained by runners, Dr. Steven I. Subotnick D.P.M. M.S. in his book *Cures for Common Running Injuries,* describes the injuries and cures, and references are made to illustrations drawn by Stanley G. Newell D.P.M. Also in the text book, *Grays Anatomy,* on pages 283 through 286, there are illustrations and descriptions of the bones, ligaments, cartilages, etc. of a person' foot and ankle. Moreover in a book entitled *Clinical Biomechanics—Volume II, Normal and Abnormal Function of the Foot,* written by Merton L. Root D.P.M., William P. Orien D.P.M., and John H. Weed D.P.M., commencing on page 46 and continuing through page 54, there are descriptions and illustrations entitled "Motion at Specific Joints of the Foot". Subsequently, on pages 121 through 123 there are descriptions and illustrations of "Compensatory Function of the Foot". Later, on pages 175 through 177, there are descriptions and illustrations entitled, "Forces Acting Upon the Foot During Locomotion".

To Summarize, in Reference to This Medical Information and Other Generally Known Information To understand the complex motions of respective portions of one's foot, ankle, leg, etc., during walking, striding, gaiting, running, water skiing, etc., one must first understand how medically trained persons refer to reference planes, reference motions, reference positions, reference conditions, reference bones, reference axes, etc. In this respect the following statements are made to assist in one's understanding of why these water ski corrective wedges are provided in the various embodiments described and illustrated herein.

In respect to a body in the anatomical position, i.e. standing, the sagital plane is a front to back vertical plane, i.e. an anterior to posterior vertical plane. The median sagital plane is a front to back vertical plane on the centerline of one's body. A transverse plane is a transverse horizontal plane. A frontal plane is a vertical transverse front plane.

With these reference planes in mind, an adduction motion of one's foot is a movement of a foot in a transverse plane about a vertical axis with the foot pivoting about the heel toward the midline of the body or toward the median sagital plane. The abduction motion of one's foot is a motion opposite to the adduction motion. One's foot pivots about the heel away from the median sagital plane.

Inversion motion of a foot, as viewed in a frontal plane, shows the plantar surface, i.e. the bottom surface, of one's foot is tilted to face toward the midline of the body, i.e. toward the median sagital plane.

Eversion motion is the opposite to inversion motion, i.e. the bottom surface of one's foot is tilted to face away from the midline of the body.

Plantarflexion is the downward pivotal motion of the distal aspect of one's foot in the sagital plane, or stated differently, the foot moves away from the tibia bone of the ankle.

Dorsiflexion motion is the opposite to plantarflexion motion, i.e. the foot pivots upwardly in the sagital plane toward the tibia bone of the ankle.

Supination is the triplane motion of one's foot in the direction of adduction, inversion, and plantarflexion. This is to say the foot is moved toward the median sagital plane, i.e. toward the centerline of a body, while tilting in, and pointing downwardly. Pronation is the opposite triplane motion in the directions of abduction, eversion, and dorsiflexion. This is to say the foot is moved away from the median sagital plane, i.e. away from the centerline of a body, while tilting out, and pointing upwardly.

When persons' bone structures in their foot area are congenitally different, then there are terms to so indicate, such as the term Varus, indicating when a person's foot is inverted, meaning the foot's plantar surface faces toward the midline of a body and away from a transverse, i.e. horizontal, plane. The term, Valgus, indicates a person's foot is everted, meaning the foot's plantar surface faces away from the midline of a body and away from a transverse, i.e. horizontal, plane.

Normal foot functions are undertaken without creating any adverse physical and/or emotional responses in a person. He or she uses their feet, etc. in an average manner in an average environment.

Hypermobility is any motion in a joint such as a joint in a foot, in response to gravitational force, when the joint should be stable under such force, i.e. hypermobility is any excessive motion in a joint.

Compensation is a change of one body part, via position and/or function, to compensate or to adjust to a deviation of structure, position, or function, of another part of the body.

Subluxation is the partial dislocation, motion contrary to a normal plane of motion, or exceeding the range of motion, of a joint of a body.

In respect to the bones of one's foot, there are in the forefoot the five digits, which are the five toes. They are supported on the ends of the five metatarsals, of which the first metatarsus supports the big toe. The lesser tarus is at the midfoot and the combined bones include navicular, cuboid, and the three cuneiforms. The tarus is at the rearfoot and the combined bones include the talus and calcaneus. The medial side of one's foot is the side of the big toe, or the first metatarsal and the lateral side of one's foot is the side of the little toe, or the fifth metatarsal.

As described on pages 7 through 19 in Dr. Steven I. Subotnick D.P.M.'s book, *Cures for Common Running Injuries,* in reference to the mechanics of motions, his discussions are of particular importance in reference to the last fifty percent of a gait, when water skiing motions are being considered. During standing, and at later gait times in reference to both walking and/or running like positions while on water skis, the bones of each foot of a water skier should be normally locked, so the foot will not unwantedly function as a loose bag of bones. There must be a time when the foot bones are locked in reference to the midtarsal joint, and the foot and the leg are positioned for maximum efficiency as a rigid lever. At this locked position, the respective bones are arranged to stabilize the forefoot, midfoot, and rearfoot. Their plantar surfaces are arranged in three spaced locations, like the legs of a three leg stool. More particularly the three legs of this imaginary stool are: the first leg is the first metatarsal; the second leg is the fifth metatarsal; and the third leg is the rearfoot, or the talus and the calcaneus bones. If this locking does not occur, it is because there is positioning beyond normal, such as abnormal pronation, which then involved excessive metatarsal motion, and in turn causes instability of the forefoot, midfoot, and rearfoot. The forefoot then acts as a bag of bones and the forefoot is not stable. The forefoot and the rearfoot then react to force, allowing the force to control the foot. In contrast when there is no abnormal pronation and locking occurs, the foot controls the forces. When water skiing, without using these corrective wedges, the forces occurring cause excessive flexure and stressing of the water skier's feet, knees, legs, and hips, and his or her feet must be abnormally pronated.

The locking of the foot bones is insured in reference to the illustrations and descriptions herein, by providing the water ski corrective wedges in ways which insure the stabilization of the foot bones, and whereby any hypermobility of the foot bones is avoided.

Explanations of Why the Corrective Wedges are Used With Water Skis

During substantially upright standing on water skis and during knee bending and back angulation movements, inbetween such substantially upright standing times there should be a normalcy at all critical times, i.e. there should be occurring at desired times some locked positions of the bones of a water skier's feet. There are these moments of time when the motion of the respective foot bones is prevented. The foot bones are then locked in reference to the midtarsal joint of each foot. At this locking time, the bones of a water skier's foot and leg are positioned for maximum efficiency during his or her static stance in making or carving a water ski turn, or during his or her crouched position in a water ski crossing of the wake of a speed boat.

At these locked positions, some of the respective foot bones have their plantar surfaces arranged for contact at three space locations, like the legs of a three leg stool. The three legs of this imaginary stool are: the first leg is the first metatarsal; the second leg is the fifth metatarsal; and the third leg is the rearfoot, or the talus and the calcaneus bones. In order to insure the water skier's feet, ankles, and legs will not be overworked or overstressed, and they will be able to be locked when such locking is wanted by a water skier, the illustrated and described corrective wedges are used in making the foot position transitions from a respective water ski binding to a respective water ski.

Multiple Plane Contoured Water Ski Binding Receiving Corrective Wedges

Figure 1:
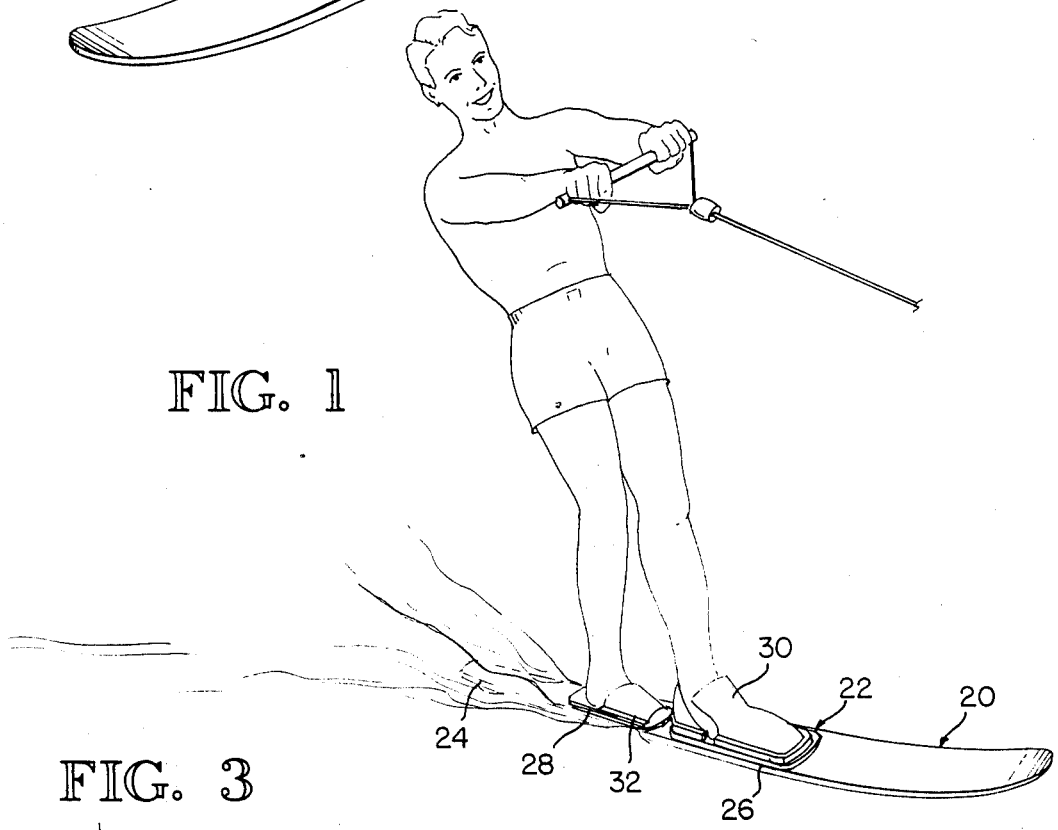
FIG. 1 is a perspective view of a water skier in one of his or her positions on the slalom water ski while skiing with his or her left foot forward.

The preferred embodiments of single and multiple plane contoured water ski binding receiving corrective wedges secured between the bindings and the slalom water skis are illustrated in the drawings. In FIG. 1 a water skier is shown in his or her position on a water slalom water ski assembly 20, while skiing at a time when the pulling speedboat's wake has been crossed, and the skier is cutting out and leaning slightly backward with legs straight and arms outstretched. When a skier is viewed from a distance, while they are in this water skiing position, his or her entire body for a few moments of time appears stiff and tense. Yet in a very real sense the water skier's body is still flexible to accommodate wave and wake motions, and soon the skier's body is often changed into various jumping positions, as the wake of the pulling boat is again crossed. At all times, the illustrated respective contoured water ski binding receiving corrective wedges, generally designated by 22, are being utilized to avoid improper stressing of the water skier's feet, knees, legs and hips, and to give the water skier a better opportunity to control the direction and stability of his or her slalom water ski 24. The water skier using these corrective wedges creates more of the control through his or her forefoot, where previously a much higher proportion of control of a water ski was created through his or her rearfoot. In respect to the illustrations, the water skier's position, as shown in FIG. 1, is followed in FIGS. 3, 8, and 15 in regard to the stiff appearing position and not to a jumping position.

Figure 2:
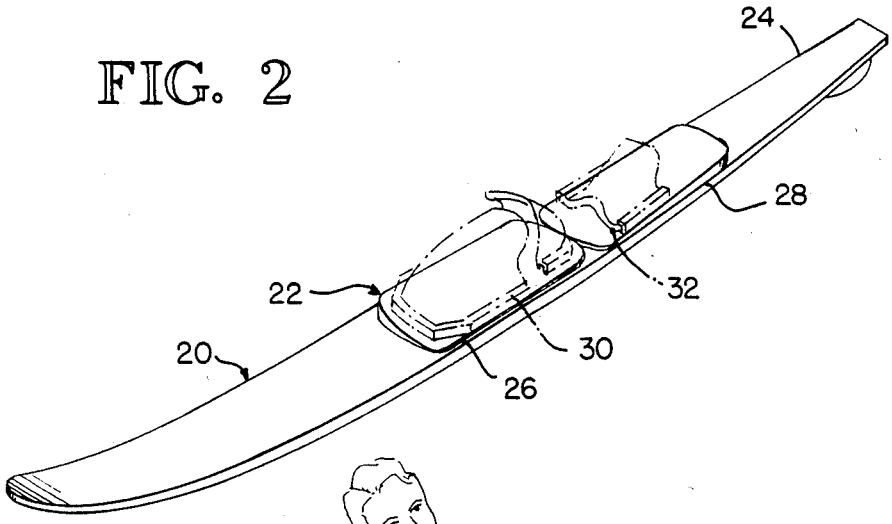
FIG. 2 is a perspective view of a slalom water ski with fore and aft multiple plane contoured water ski binding receiving corrective wedges secured between the bindings and the water skis.
Figure 3:
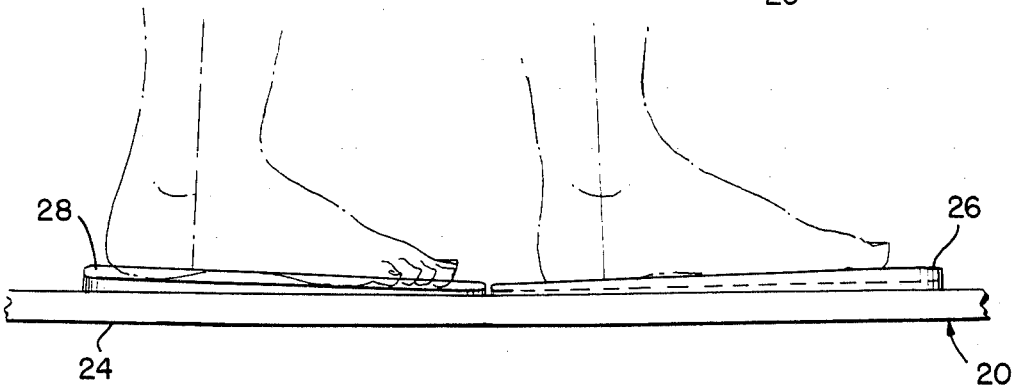
FIG. 3 is a partial right side view of the slalom water ski illustrating the positions of the feet and legs of a water skier in respect to his or her use of the multiple plane contoured water ski binding receiving corrective wedges, and for illustrative purposes the water ski binding is not shown.

In FIG. 2 a slalom water ski assembly 20 is shown which has fore and aft multiplane contoured water ski binding receiving corrective wedges 26, 28 secured between the fore and aft bindings 30, 32 and the slalom water ski per se 24. The multiplane contours of these fore and aft corrective wedges 26, 28 are illustrated also in FIG. 3, as viewed from the same side as in FIG. 1. Also shown in FIG. 3 are some portions of the lower legs of the water skier, and his or her feet, but for illustrative purposes the water ski bindings 30, 32 forward and aft, are not shown. As viewed in FIG. 3, in respect to the sagital plane, the water skier's feet are comfortably positioned with an essentially ninety degree angle being maintained in respect to the water skier's legs. In this position, the leg with respect to the heel is closer to a normal position, and the heel with respect to the forefoot is closer to a normal position.

In respect to looking down on a slalom water ski 24, with corrective wedges 26, 28 in place but without showing the ski bindings 30, 32, the positioning of the feet of a water skier are illustrated in FIGS. 4 and 5. The new preferred positioning in respect to the preferred embodiment is shown in FIG. 4, wherein the water skier's feet are positioned in a more comfortable angular location with respect to the longitudinal axis of the slalom water ski 24. However, if preferred by a water skier, he or she may still keep their feet aligned with the longitudinal axis of the slalom water ski as illustrated in FIG. 5. The angular location shown in FIG. 4 adds another geometric plane of change of the multiple plane contoured water ski binding receiving corrective wedges 22, to assist a water skier in obtaining a more comfortable and less stressful position on a slalom water ski assembly 20.

Figure 9:
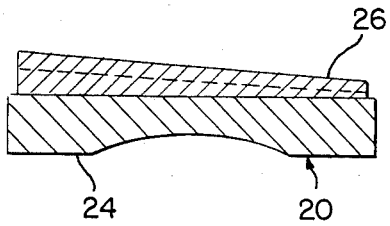
FIG. 9 is a cross sectional view of the slalom water ski and the forward multiple plane contoured water ski binding receiving corrective wedge taken along section line 9—9 of FIG. 8 to indicate the multiple plane contour of the forward receiving corrective wedge.
Figure 10:
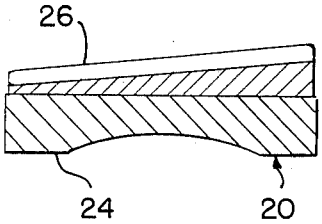
FIG. 10 is a cross sectional view of the slalom water ski and the aft or rear multiple contoured water ski binding receiving corrective wedge taken along section line 10—10 of FIG. 8 to indicate the multiple plane contour of the aft or rear receiving corrective wedge.

In the following FIGS. 8 through 10, the fore and aft multiple plane corrective wedges 26, 28, for illustrative purposes, are shown aligned with the longitudinal axis of the slalom water ski, indicating position adjustments in respect to two planes or two orientations in respect to the positions of each binding forward or aft, 30, 32. However, in all of these views, the angularity illustrated in FIGS. 4, 6 and 7, should be considered as being optionally incorporated. If so incorporated in an actual completed slalom water ski assembly 20, the water skier is then benefitting from changes in respect to three orientations in regard to each multiple plane corrective wedge 22.

In FIGS. 6 and 7, the partial front views show how the water skier's feet, ankles, and legs, are positioned in reference to the forward and aft multiplane corrective wedges 26, 28 and in reference to FIG. 4 with respect to the angular positions. In these FIGS. 6 and 7, portions of the slalom water ski 24 are illustrated, but no portions of the forward and aft water ski bindings 30, 32 are shown. By using these multiple plane forward and aft corrective wedges 26, 28, whether aligned or angularly positioned in respect to FIG. 5 or 4, the heel of each water skier's foot is positioned perpendicular to the forefoot and also the heel is positioned perpendicular to the lower part of the water skier's leg. This beneficial perpendicular positioning in respect to both the skier's leg and foot in the forward position and the skier's other leg and foot in the rear position, not only decreases the potential of high stresses, but like all the other illustrated beneficial positioning of his or her feet and legs, via the corrective wedges 22, the water skier increases his or her control over the directional movement of the slalom water ski assembly 20, with more of the control being effected by the forefoot of a water skier.

Figure 8:
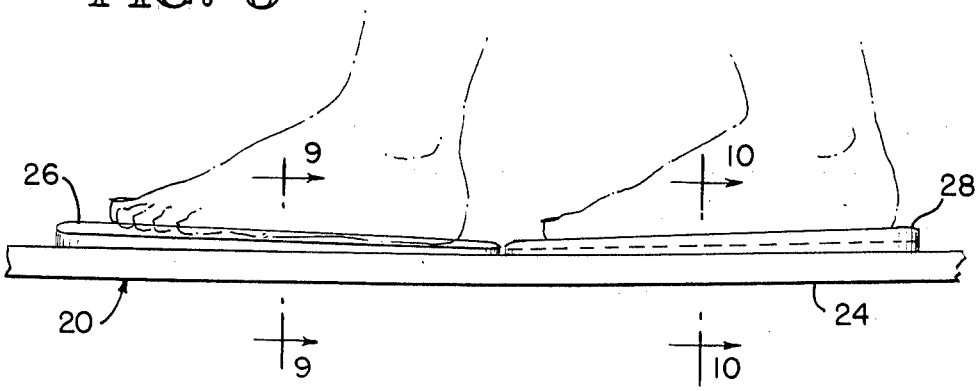
FIG. 8 is an enlarged partial left or port side view of the slalom water ski and the fore and aft multiple plane contoured water ski binding receiving corrective wedges, before the installation of the water ski bindings showing the left foot forward.

In FIG. 8 only a portion of a water slalom ski 24 is shown in conjunction with the fore and/or aft multiple plane corrective wedges 26, 28, to further illustrate the shapes of these corrective wedges in relationship to the water slalom ski 24. The fore and aft bindings 38, 32 are not shown. In FIG. 8 the left or port side is shown. The right or starboard side is shown in FIG. 3. FIG. 9 is a cross sectional view taken at line 9—9 in FIG. 8 of the forward multiple plane contoured water ski binding receiving corrective wedge 26. FIG. 10 is a cross sectional view taken at line 10-10 in FIG. 8 of the rear or aft multiple plane contoured water ski binding receiving corrective wedge 28.

Although the multiple plane corrective wedges 26, 28 are preferred, and also their angular positions, as shown in FIG. 4 are preferred, a water skier may choose not to use corrective wedges which are angularly placed. Moreover, whether angularly placed, or placed in alignment with the longitudinal axis of a slalom water ski 24, a water skier may choose to use corrective wedges 22, which only are shaped in reference to one plane at either the fore and/or aft positions. In this respect, some of a water skier's selections of different single plane corrective wedges 22 are shown in FIGS. 11 through 17.

Single Plane Transverse Angular Change Corrective Wedges

In FIGS. 11 and 12, the respective left and right, i.e. port and starboard, sides of a slalom water ski 24, equipped with forward and aft corrective wedges 34, 36, each having only a single plane transverse angular change, are illustrated. In respect to the frontal plane reference of the water skier, these corrective wedges 34, 36 are utilized to avoid inversion or eversion motions of a water skier's feet. In FIG. 13, the cross section of corrective wedge 34 is shown in reference to line 13—13 of FIG. 11. In FIG. 14, the cross section of corrective wedge 36 is shown on reference to line 14—14 of FIG. 11.

Single Plane Longitudinal Angular Change Corrective Wedges

In FIG. 15, the right of stardboard side of a slalom water ski 24, equipped with forward and aft corrective wedges 38, 40, each having only a single plane longitudinal angular change, are illustrated. The view from the left or starboard side would show the same relative thickness changes of these corrective wedges 38, 40. As considered in reference to a sagital plane of the water skier, these corrective wedges 38, 40 are utilized to avoid plantarflexior or dorsiflexion motion of a water skier's feet and also to substantially maintain the ninety degree angle between the feet and legs of a water skier.

In FIG. 16 the cross section of corrective wedge 38 is shown in reference to line 16—16 of FIG. 15. In FIG. 17, the cross section of corrective wedge 40 is shown in reference to line 17—17 of FIG. 15.

Other Selected Embodiments of Corrective Wedges

A water skier may also elect to use a multiple plane corrective wedge either at a fore or aft location and at the other position use only a single plane corrective wedge on his or her selected slalom water ski. Also water skiers, preferring to water ski on two water skis, rather than on one slalom water ski, may elect to use corrective wedges of one or more plane changes to assist them in avoiding excessive stresses and in improving their control of the directional movements of their two side by side water skis.

The corrective wedges 22, in all their illustrated embodiments 26, 28, 34, 36, 38, 40, are made of wood and plastic materials. They are provided as separate items to be selected by a water skier and installed on his or her water skis. Also they could be integrally formed in the water skis when they are made.

By way of example the following specifications are given as to sizes, angles, and/or materials:

The materials such as wood and plastic must be durable, especially in saltwater. Other materials of comparable durability could be used. The minimum thickness is governed by the strength of the material, so it will not readily break away along an edge. Generally an eighth of an inch is recommended as the minimum thickness. The widths are not wider than the water skis, but preferably not wider than the ski bindings. The lengths are preferably not longer than the ski bindings.

The angles, selected for the corrective wedges, are to be in the range of the differences in angularity between a water skier's measured angle, when he or she is normally standing with his or her feet spaced apart, and then when he or she is positioned on a slalom ski, with one foot positioned ahead of the other foot.

In respect to the frontal plane, the angular change in respect to the left leg can range from 3 to 6 degrees. In respect to the frontal plane, the angular change in respect to the right leg can range from 4 to 6 degrees. If one adds the respective normal varus of one's leg and one's forefoot, the correction could be from 3 to 15 degrees.

In respect to the sagital plane, the dorsiflexion angle can range from 5 to 22 degrees, and the plantarflexion angle can range from 5 to 22 degrees.

These angles help in establishing the selected and/or average angles of the multiple plane surfaces of the corrective wedges to provide water skiers with greater control over their water skis, as their respective forefoots become more active in controlling the water skis.

As viewed in FIG. 8, in reference to the range of these angles, the forward corrective wedge, made in reference to some selected angles, could slope longitudinally 13 degrees from front to the back, and could slope transversely 3 degrees from right to left. The rear corrective wedge, made in reference to some selected angles, could slope transversely 5 degrees, and could slope longitudinally 13 degrees from the back to the front.

In respect to all the embodiments, a water skier is provided with corrective wedges, which make his or her water skiing periods more enjoyable. They have better water ski control, and they experience fewer stressful moments during their water skiing runs.

I claim:

1. Single plane contoured water ski binding receiving corrective wedges adapted for securement between bindings and a slalom water ski, comprising:

(a) a forward corrective wedge having a bottom surface to fit the top surface of a slalom water ski at a forward foot location on the slalom water ski and a top surface, sloping longitudinally downwardly from toe to heel, to receive a water ski forward binding, which in turn will position the forward located foot and leg of a water skier in a near neutral position;

(b) a rear corrective wedge having a bottom surface to fit the top surface of a slalom water ski at the rear foot location on the slalom ski water ski and a top surface sloping longitudinally downwardly from heel to toe to receive a water ski rear binding, which in turn will position the rear located foot and leg of a water skier in a near neutral position.

2. Single plane contoured water ski binding receiving corrective wedges, as claimed in claim 1 wherein both the forward corrective wedge and the rear corrective wedge are adapted to be placed at respective opposite angles with respect to the longitudinal center of a slalom water ski, to further position the water skier's feet and legs in their near neutral positions on a slalom water ski.

3. Multiple plane contoured water ski binding receiving corrective wedges adapted for securement between the bindings and a slalom water ski, and for use by a water skier placing his or her right foot behind his or her left foot, comprising:

(a) a forward corrective wedge having a bottom surface to fit the top surface of a slalom water ski at a forward left foot location on the slalom water ski, and a top surface, both sloping longitudinally downwardly from toe to heel, and sloping transversely downwardly from the medial side to the lateral side of the water skier's left foot, to receive a water skier's forward foot binding, which in turn will position the forward located left foot and leg of a water skier in a nearer neutral position;

(b) a rear corrective wedge having a bottom surface to fit the top surface of a slalom water ski at a rear right foot location on a slalom water ski, and a top surface, both sloping longitudinally downwardly from heel to toe, and sloping transversely downwardly from the medial side to the lateral side of the skier's right foot, to receive a water skier's rear foot binding, which in turn will position the rear located right leg of a water skier in a nearer neutral position.

4. Multiple plane contoured water ski binding receiving corrective wedges, as claimed in claim 3, wherein the forward corrective wedge is adapted to be placed at an angle slightly pointing to the right of the longitudinal center of a slalom water ski, to farther position the water skier's left foot in a nearer neutral position on a slalom water ski, and the rear corrective wedge is adapted to be placed at an angle slightly pointing to the left of the longitudinal center of a slalom water ski, to farther position the water skier's right foot in a nearer neutral position on a slalom water ski.

5. Multiple plane contoured water ski binding receiving corrective wedges adapted for securement between the bindings and a slalom water ski, and for use by a water skier placing his or her left foot behind his or her right foot, comprising:

(a) a forward corrective wedge having a bottom surface to fit the top surface of a slalom water ski at a forward right foot location on the slalom water ski, and a top surface, both sloping longitudinally downwardly from toe to heel, and sloping transversely downwardly from the medial side to the lateral side of the water skier's right foot, to receive a water skier's forward foot binding, which in turn will position the forward located right foot and leg of a water ski in a nearer neutral position;

(b) a rear corrective wedge having a bottom surface to fit the top surface of a slalom water ski at a rear left foot location on a slalom water ski, and a top surface, both sloping longitudinally downwardly from heel to toe, and sloping transversely downwardly from the medial side to the lateral side of the water skier's left foot, to receive a water skier's rear foot binding, which in turn will position the rear located left leg of a water skier in a nearer neutral position.

6. Multiple plane contoured water ski binding receiving corrective wedges, as claimed in claim 5, wherein the forward corrective wedge is adapted to be placed at an angle slightly pointing to the left to the longitudinal center of a slalom water ski, to farther position the water skier's right foot in a nearer neutral position on a slalom water ski, and the rear corrective wedge is adapted to be placed at an angle slightly pointing to the right of the longitudinal center of a slalom water ski, to farther position the water skier's left foot in a near neutral position on a slalom water ski.

7. A slalom water ski having an integral single plane contoured water ski binding receiving surface, at a forward foot location, sloping longitudinally downwardly from toe to heel, to receive a water skier's forward binding, which in turn will position the forward located foot and leg of a water skier in a nearer neutral position; and an integral single plane contoured water ski binding receiving surface at a rear foot location sloping longitudinally downwardly from the heel to toe, to receive a water ski rear binding, which in turn will position the rear located foot and leg of a water skier in a nearer neutral position.

8. A slalom water ski, as claimed in claim 7, wherein both the forward integral single plane contoured water ski binding recieving surface, and the rear integral single plane contoured water ski binding receiving surface are arranged at respective opposite angles with respect to the longitudinal center of a slalom water ski to farther position the water skier's feet and legs in their neutral positions on the slalom water ski.

9. A slalom water ski having an integral multiple plane contoured water ski binding receiving surface at a forward left foot location on a slalom water ski, both sloping longitudinally downwardly from toe to heel, and sloping transversely downwardly from the medial side to the lateral side of the water skier's left foot, to receive a water skier's forward foot binding, which in turn will position the forward located left foot and leg of a water skier in a nearer neutral position; and an integral multiple plane contoured water ski binding receiving surface at a rear right foot location on a slalom water ski, both sloping longitudinally downwardly from heel to toe, and sloping transversely downwardly from the medial side to the lateral side of the water skier's right foot, to receive a water skier's rear foot binding, which in turn will position the rear located right foot and leg of a water skier in a nearer neutral position.

10. A slalom water ski, as claimed in claim 9, wherein the forward water skier's binding receiving surface at the forward left foot location is contoured at an angle slightly pointing to the right of the longitudinal center of the slalom water ski, and the rear water skier's binding receiving surface at the rear right foot location is contoured at an angle slightly pointing to the left of the longitudinal center of the slalom water ski to farther position the water skier's feet in nearer neutral positions on the slalom water ski.

11. A slalom water ski having a integral multiple plane contoured water ski binding receiving surface at a forward right foot location on slalom water ski, both sloping longitudinally downwardly from toe to heel, and sloping transversely downwardly from the medial side to the lateral side of the water skier's right foot, to receive a water skier's forward foot binding, which in turn will position the forward located right foot and leg of a water skier in a nearer neutral position; and an integral multiple plane contoured water ski binding receiving surface at the rear left foot location on a slalom water ski, both sloping longitudinally downwardly from heel to toe, and sloping transversely downwardly from the medial side to the lateral side of the water skier's left foot, to receive a water skier's rear foot binding, which in turn will position the rear located left foot and leg of a water skier in a nearer neutral position.

12. A slalom water ski, as claimed in claim 11, wherein the forward water ski binding receiving surface at the forward right foot location is contoured at an angle slightly pointing to the left of the longitudinal center of the slalom water ski, and the rear water ski binding receiving surface at the rear left foot location is contoured at an angle slightly pointing to the right of the longitudinal center of the slalom water ski, to farther position the water skier's feet in nearer neutral positions on the slalom water ski.

13. Slalom water skier's bindings having integral corrective wedges adapted for securement on a slalom water ski at a forward foot location and a rear foot location for use by a water skier, comprising:

(a) a forward slalom water skier's binding having an integral corrective wedge throughout its bottom, having a bottom surface to fit the top surface of a slalom water ski at the forward foot location on the slalom water ski, and a foot receiving top surface sloping longitudinally downwardly from toe to heel, to position the forward located foot and leg of a water skier in a nearer neutral position; and (b) a rear slalom water skier's binding having an integral corrective wedge throughout its bottom, having a bottom surface to fit the top surface of a slalom water ski at the rear foot location on the slalom water ski, and a foot receiving top surface sloping longitudinally downwardly from heel to toe, to position the rear located foot and leg of a water skier in a nearer neutral position.

14. Slalom water skier's bindings having integral corrective wedges, as claimed in claim 13, wherein both this forward water skier's binding and this rear water skier's binding are adapted to be arranged at respective opposite angles with respect to the longitudinal center of a slalom water ski to farther position the water skier's feet and legs in their neutral positions on the slalom water ski.

15. Slalom water skier's bindings having integral corrective wedges adapted for securement on a slalom water ski for use by a water skier placing his or her right foot behind his or her left foot, comprising:

(a) a forward slalom water skier's binding having an integral corrective wedge throughout its bottom, having a bottom surface to fit the top surface of a slalom water ski at a forward left foot location on the slalom water ski, and a left foot receiving top surface, both sloping longitudinally downwardly from toe to heel, and sloping transversely downwardly from the medial side to the lateral side of the water skier's left foot, to position the forward located left foot and leg of a water skier's in a nearer neutral position;

(b) a rear slalom water skier's binding having an integral corrective wedge throughout its bottom, having a bottom surface to fit the top surface of a slalom water ski at a rear right foot location on the slalom water ski, and the right foot receiving top surface, both sloping longitudinally downwardly from heel to toe, and sloping transversely downwardly from the medial side to the lateral side of the water skier's right foot, to position the rear located right foot and leg of a water skier in a nearer neutral position.

16. Slalom water skier's bindings having integral corrective wedges, as claimed in claim 15, wherein this forward water skier's binding is adapted to be placed at an angle slightly pointing to the right of the longitudinal center of a slalom water ski, to farther position the water skier's left foot in a nearer neutral position on a slalom water ski, and this rear water skier's binding is adapted to be placed at an angle slightly pointing to the left of the longitudinal center of a slalom water ski, to farther position the water skier's right foot in a nearer neutral position on a slalom water ski.

17. Slalom water skier's bindings having integral corrective wedges adapted for securement on a slalom water ski for use by a water skier placing his or her left foot behind his or her right foot, comprising:

(a) a forward slalom water skier's binding having an integral corrective wedge throughout its bottom, having a bottom surface to fit the top surface of a slalom water ski at a forward right foot location on a slalom water ski, and the right foot receiving top surface, both sloping longitudinally downwardly from toe to heel, and sloping transversely downwardly from the medial side to the lateral side of the water skier's right foot, to position the forward located right foot and leg of a water skier in a nearer neutral position; and (b) a rear slalom water skier's binding having an integral corrective wedge throughout its bottom, having a bottom surface to fit the top surface of a slalom water ski at the rear left foot location on a slalom water ski, and the left foot receiving top surface, both sloping longitudinally downwardly from heel to toe, and sloping transversely downwardly from the medial side to the lateral side of the water skier's left foot, to position the rear located left foot and leg of a water skier in a nearer neutral position.

18. Slalom water skier's bindings having integral corrective wedges, as claimed in claim 17, wherein this forward water ski binding is adapted to be placed at an angle slightly pointing to the left of the longitudinal center of a slalom water ski, to farther position the water skier's right foot in a nearer neutral position on a slalom water ski, and this rear water ski binding is adapted to be placed at an angle slightly pointing to the right of the longitudinal center of a slalom water ski, to farther position the water skier's left foot in a nearer neutral position on a slalom water ski.

* * * * *